US009844236B2

(12) United States Patent
Miller

(10) Patent No.: US 9,844,236 B2
(45) Date of Patent: Dec. 19, 2017

(54) CONVERTIBLE GARMENT

(71) Applicant: Melanie A. Miller, Shawnee, KS (US)

(72) Inventor: Melanie A. Miller, Shawnee, KS (US)

( * ) Notice: Subject to any disclaimer, the term of this patent is extended or adjusted under 35 U.S.C. 154(b) by 198 days.

(21) Appl. No.: 14/565,872

(22) Filed: Dec. 10, 2014

(65) Prior Publication Data

US 2015/0164155 A1 Jun. 18, 2015

Related U.S. Application Data

(60) Provisional application No. 61/916,372, filed on Dec. 16, 2013.

(51) Int. Cl.
*A41D 15/00* (2006.01)
*A41D 13/12* (2006.01)
*A41D 1/06* (2006.01)

(52) U.S. Cl.
CPC ..... *A41D 15/002* (2013.01); *A41D 1/06* (2013.01); *A41D 13/1209* (2013.01)

(58) Field of Classification Search
CPC ..... A41D 15/002; A41D 2200/10; A41D 2400/42; A41D 2400/424; A41D 13/01; A41F 9/00
USPC ..... 2/236, 237, 220
See application file for complete search history.

(56) References Cited

U.S. PATENT DOCUMENTS 235,875 A * 12/1880 Horner ..... 2/269
1,306,935 A * 6/1919 Walcoff ..... 2/228
2,187,447 A * 1/1940 Chait et al. ..... 2/227
2,441,274 A * 5/1948 Murray ..... 2/79
3,849,804 A * 11/1974 Rakow ..... 359/518
4,149,275 A * 4/1979 Sanchez ..... 2/269
4,200,938 A * 5/1980 LeTourneau ..... 2/269
4,697,288 A * 10/1987 Palumbo ..... 2/269
4,985,936 A * 1/1991 Jones ..... 2/269
5,050,244 A * 9/1991 Kleinman ..... 2/227
5,088,128 A * 2/1992 Kape ..... 2/269
5,539,932 A * 7/1996 Howard ..... 2/269
5,652,961 A * 8/1997 Knight-Yurt ..... 2/114
5,774,892 A * 7/1998 Tisdale et al. ..... 2/69
5,787,511 A * 8/1998 Garside ..... 2/269
6,138,282 A * 10/2000 Follese ..... 2/400
2006/0236440 A1* 10/2006 Zahler ..... 2/69
2006/0260025 A1* 11/2006 Voege ..... 2/269
2007/0101475 A1* 5/2007 Skottheim ..... 2/69
(Continued)

*Primary Examiner* — Khaled Annis
(74) *Attorney, Agent, or Firm* — Dale J. Ream

(57) ABSTRACT

A convertible garment includes a waist portion having a continuous upper edge and a pair of leg portions extending downwardly from the waist portion. Each leg portion includes a lower end. The convertible garment includes an upper auxiliary portion having a continuous lower edge coupled to the upper edge of the waistband and an opposed free upper edge. The upper auxiliary portion is movable between a folded configuration adjacent the waist portion and an extended configuration extending away from the waist portion. The convertible garment includes a pair of lower auxiliary portions each having an upper edge coupled to respective lower ends of respective leg portions and an opposed free edge, respective lower auxiliary portions being movable between a folded configuration adjacent respective leg portions and an extended configuration extending away from respective lower ends of respective leg portions.

13 Claims, 7 Drawing Sheets

(56) References Cited

U.S. PATENT DOCUMENTS

| | | | | |
|---|---|---|---|---|
| 2007/0169250 | A1* | 7/2007 | Maniguet | 2/227 |
| 2007/0245460 | A1* | 10/2007 | Ryan et al. | 2/232 |
| 2008/0104742 | A1* | 5/2008 | Alperin et al. | 2/321 |
| 2008/0127398 | A1* | 6/2008 | Ryan | 2/269 |
| 2008/0295225 | A1* | 12/2008 | Hendrickson et al. | 2/237 |
| 2009/0172859 | A1* | 7/2009 | Clement | 2/69 |
| 2009/0235434 | A1* | 9/2009 | Ratcliffe | 2/269 |
| 2010/0175166 | A1* | 7/2010 | Bradt | |
| 2010/0281601 | A1* | 11/2010 | Clarke et al. | 2/236 |
| 2010/0299802 | A1* | 12/2010 | Bailey et al. | 2/70 |
| 2011/0185476 | A1* | 8/2011 | Boisseau et al. | 2/243.1 |
| 2013/0019370 | A1* | 1/2013 | Dweck et al. | 2/67 |
| 2013/0305426 | A1* | 11/2013 | Walrich et al. | 2/69 |
| 2014/0317832 | A1* | 10/2014 | Allen et al. | 2/236 |
| 2014/0338101 | A1* | 11/2014 | Moore | 2/237 |
| 2015/0007379 | A1* | 1/2015 | Cockram | 2/236 |
| 2015/0174434 | A1* | 6/2015 | Condon et al. | 2/457 |

* cited by examiner

CONVERTIBLE GARMENT

REFERENCE TO RELATED APPLICATIONS

The present invention claims the benefit of U.S. Provisional Patent Application Ser. No. 61/916,372 filed on Dec. 16, 2013 titled Convertible Garment and is incorporated herein by reference.

BACKGROUND OF THE INVENTION

This invention relates to apparel and, more particularly, to a garment that is convertible between pants known as "scrubs" and more formal slacks.

Scrubs are the simple trousers and shirts worn by nurses, surgeons, midwives, and other medical personnel when preparing for or performing medical procedures, surgery, or the like. Scrubs are most frequently worn in a hospital environment but are also seen in other "clean" environments such as laboratories, physical therapy, and doctor's offices in general.

Scrubs are typically worn as a replacement to normal clothing in that "street" clothing is assumed to be contaminated. In addition, scrubs are lightweight and without bulky or ornamental components that may interfere with a medical procedure. When a person wearing scrubs is finished with a medical procedure or completes a work shift altogether, he may desire to change into clothing that is more formal and attractive. Similarly, a person wearing scrubs may simply desire a more formal appearance when going to lunch, supper, or to another event, especially when there is little or no time to completely change attire.

Therefore, it would be desirable to have a convertible garment that is adjustable between substantially traditional scrub trousers and more formal slacks. Further, it would be desirable to have a convertible garment having upper and lower auxiliary portions that are selectively foldable out of the way or deployed to a more fashionable configuration

SUMMARY OF THE INVENTION

A convertible garment according to the present invention includes a waist portion having a continuous upper edge and a pair of leg portions extending downwardly from the waist portion. Each leg portion includes a lower end. The convertible garment includes an upper auxiliary portion having a continuous lower edge coupled to the upper edge of the waistband and an opposed free upper edge. The upper auxiliary portion is movable between a folded configuration in which a front surface of the upper auxiliary portion is adjacent to or bears against the waist portion and an extended configuration extending away from the waist portion or being vertically co-planar therewith. The convertible garment includes a pair of lower auxiliary portions each having an upper edge coupled to respective lower ends of respective leg portions and an opposed free edge, respective lower auxiliary portions being movable between a folded configuration in which a front face is adjacent respective leg portions and an extended configuration extending away from respective lower ends of respective leg portions.

Therefore, a general object of this invention is to provide a convertible garment that enables a person in a medical occupation to have a functional "scrubs" garment that converts to an aesthetically pleasing active wear garment.

Another object of this invention is to provide a convertible garment, as aforesaid, having an upper auxiliary portion that can be folded over a waistband for functional use as scrubs or extended upwardly for the appearance of formal slacks.

Still another object of this invention is to provide a convertible garment, as aforesaid, having a lower auxiliary portion attached to the lower end of each leg portion, each lower auxiliary portion being foldable upwardly and secured while the garment is used as "scrubs" or lengthened when worn as slacks.

Yet another object of this invention is to provide a convertible garment, as aforesaid, that is easy to convert between scrubs and slacks.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A convertible garment according to a preferred embodiment of the present invention will now be described in detail with reference to FIGS. 1 to 7 of the accompanying drawings.

The convertible garment 10 includes a waist portion 20 and a pair of leg portions 40 extending downwardly from the waist portion 20 in a substantially traditional manner. More particularly, the waist portion 20 may include a continuous upper edge 22 and may include an elastic or other resilient material in its construction. In other words, the waist band of the convertible garment does not separate in front in the manner of traditional jeans or slacks. The upper edge 22 of the waist portion 20, however, is not the uppermost end of the garment as will be explained more fully below.

Figure 1:
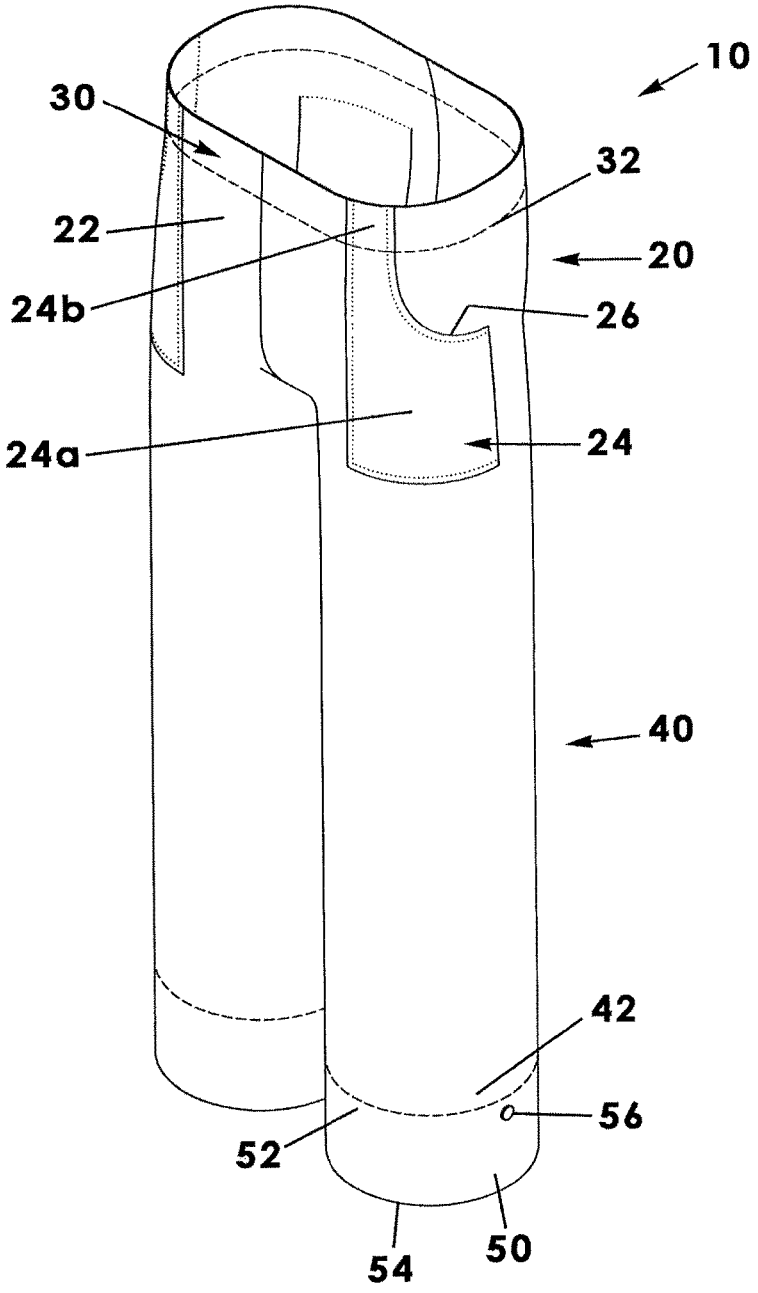
FIG. 1 is a front perspective view of a convertible garment according to one embodiment of the present invention, illustrating a lower and an upper auxiliary portion in extended configurations.
Figure 2:
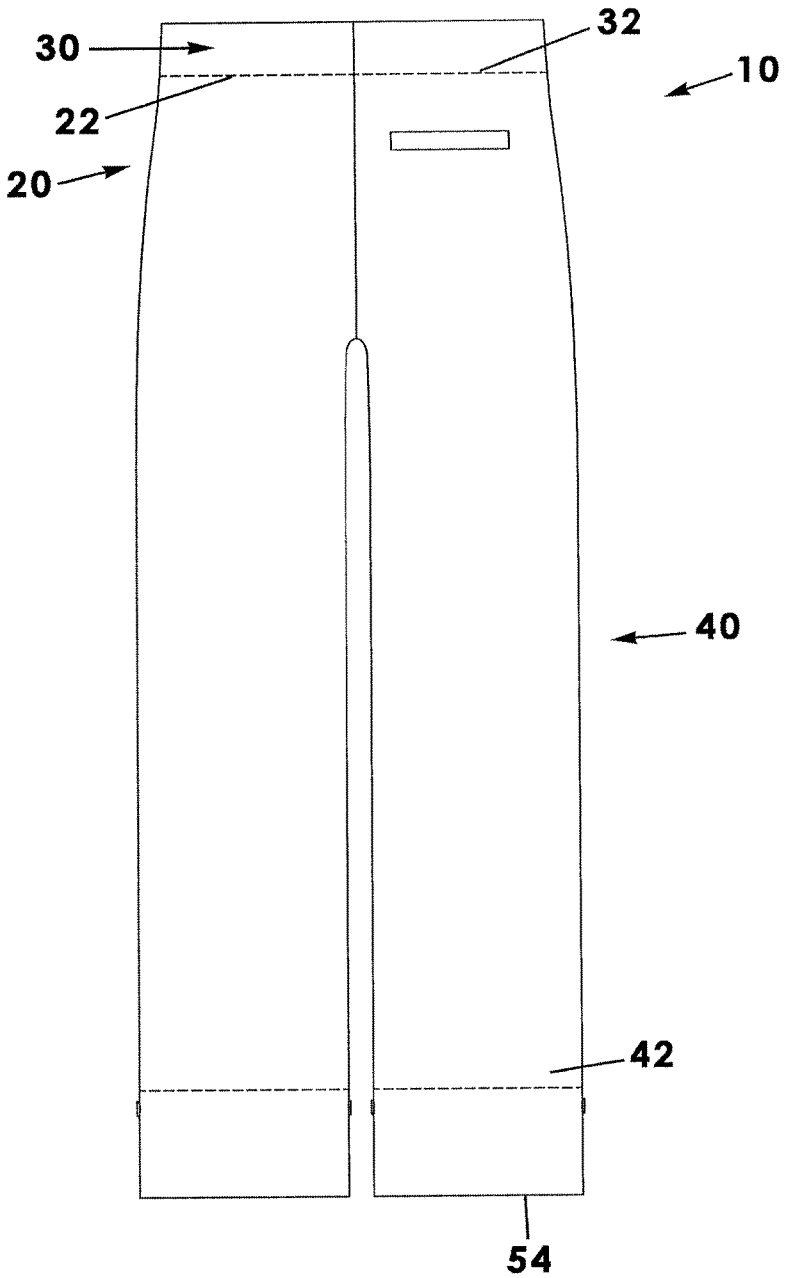
FIG. 2 is a rear view of the convertible garment as in FIG. 1.
Figure 3:
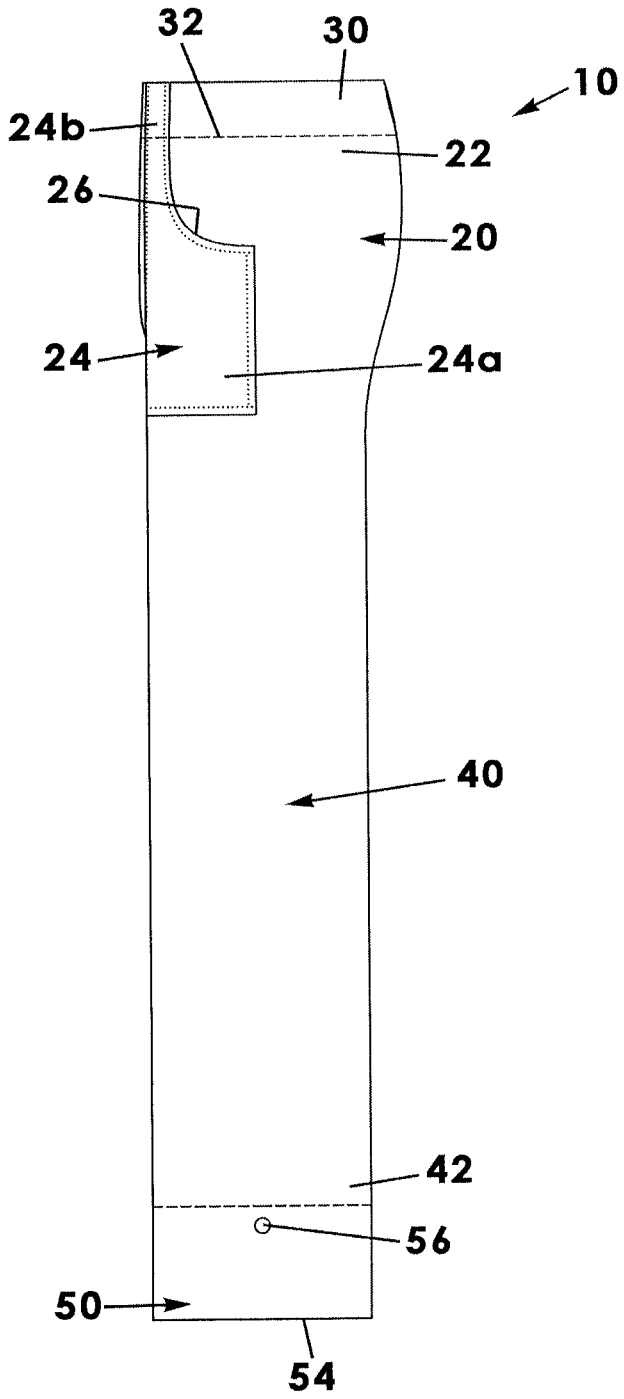
FIG. 3 is a side view of the convertible garment as in FIG. 1.

The convertible garment 10 includes an upper auxiliary portion 30 having a continuous lower edge 32 coupled to the upper edge 22 of the waist portion 20. This connection may be by sewing or as an integrated or unitary construction of material. In one embodiment, the line of connection may include a seam such that the upper auxiliary portion 30 may be folded over upper edge 22 or extended upwardly therefrom depending on the preference or current need of a wearer of the garment. Specifically, the upper auxiliary portion 30 is movable between a folded configuration in which a front surface thereof is adjacent to or rests against a front surface of the waist portion 20 (FIG. 4) and an extended configuration in which the front surface thereof is extended or displaced away from the front surface of the waist portion 20 (FIG. 1). Preferably, the upper auxiliary portion 30 is positioned above and in the same vertical plane as the waist portion 20. Upper edge 22 defines a continuous longitudinal axis about which the upper auxiliary portion 30 is selectively folded. At the extended configuration, the convertible garment 10 may have the appearance of a more formal garment such as casual or even dress slacks.

Each of the leg portions 40 includes a lower end 42 although not the lowermost extent of each leg portion 40. Specifically, the convertible garment 10 also includes a pair of lower auxiliary portions 50, each lower auxiliary portion 50 having a continuous upper edge 52 connected to a respective lower end 42 of a respective leg portion 40 and having opposed free edges 54. Respective free edges 54 are opposed to the upper edges 52. Again, the lower end 42 of a respective leg portion 40 may be connected to respective lower auxiliary portions 50 with a seam or simply have an integrated or unitary structure.

Each lower auxiliary portion 50 is movable between a folded configuration in which a front face thereof is adjacent to or resting against a front face of a respective leg portion 40 and an extended configuration in which the front face of the respective leg portion extends away from a respective leg portion 40. The lower auxiliary portion 50 is generally parallel to a respective leg portion 40 at the folded configuration and is generally coplanar with a respective leg portion 40 at the extended configuration. In the folded configuration (FIG. 5), the garment 10 is functional for use as traditional scrubs whereas in the extended configuration, the leg portions 40 are lengthened to appear more formal (FIG. 1).

Figure 4:
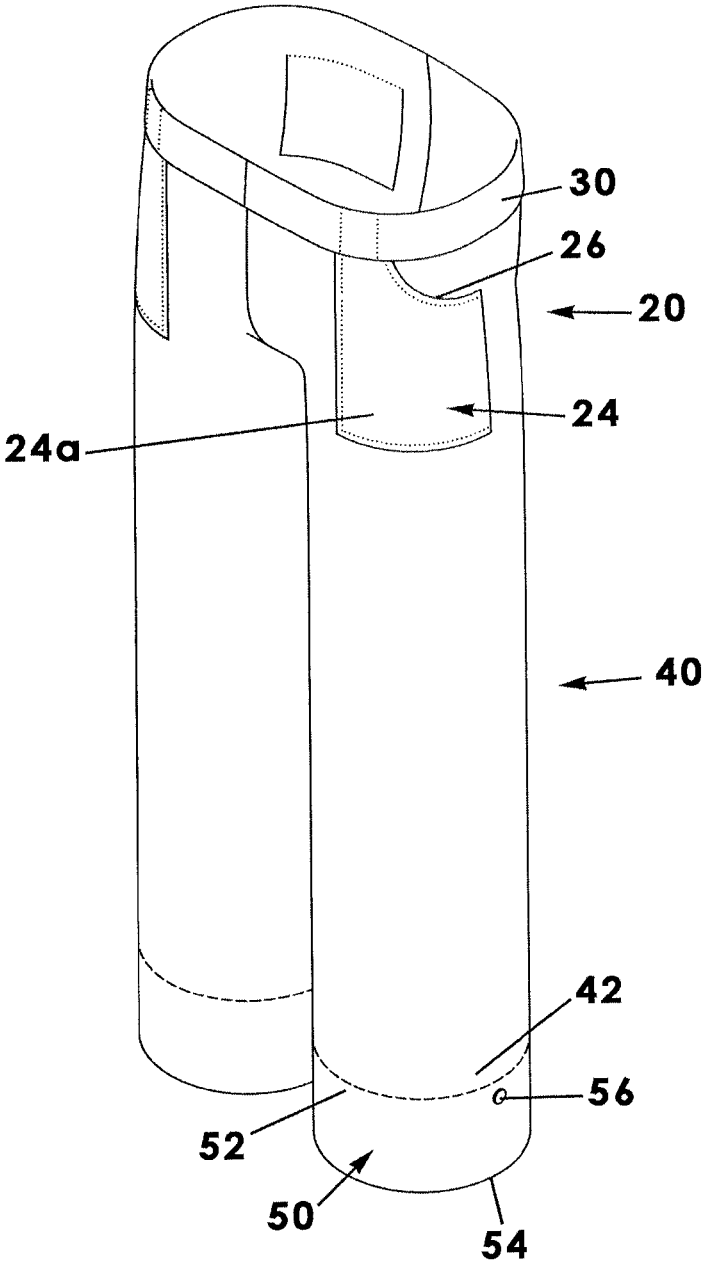
FIG. 4 is a front perspective view of the convertible garment illustrated with an upper auxiliary portion in a folded configuration.

The convertible garment 10 includes straps and fasteners that cooperate to hold the lower auxiliary portions 50 in either the folded configurations (FIG. 5) or to release them to the extended configurations (FIG. 1). More particularly, at least one first fastener 56 is situated adjacent a respective lower end 42 of respective leg portions 40 (FIG. 4). Preferably, a plurality of first fasteners 56 are spaced apart adjacent the lower ends 42. Each first fastener 56 may be a snap fastener although other fasteners such as latches, clasps, hook and loop fasteners, hooks, magnets, or the like may also be included. It is understood that while the first fasteners 56 are illustrated as being positioned on an upper extent of the lower auxiliary portions 50, they may, in one embodiment, be positioned on respective leg portions 40 themselves.

In addition, at least one strap 58 is coupled at one end to respective lower auxiliary portions 50 adjacent respective free edges 54 thereof. Each strap 58 includes a second fastener 57 at its distal/free end having a configuration that is complementary to a configuration of each first fastener 56. For instance, fasteners 56 and 57 may be mating snaps, hook and loop elements, magnets or the like. Accordingly, respective first and second fasteners may be selectively coupled together so as to hold respective lower auxiliary portions 50 in the folded configurations as described above (FIG. 5). Conversely, an uncoupling of respective first and second fasteners causes respective lower auxiliary portions 50 to extend downwardly to the extended or lengthened configurations (FIG. 1).

In one embodiment, each lower auxiliary portion 50 includes an inner surface 59 having reflective elements or being constructed of a reflective material. In this regard, a user wearing the convertible garment 10 may position respective lower auxiliary portions 50 at the folded configuration (FIG. 5) when walking on a dimly lit street or other environment in which drawing attention to the light of automobiles would be desirable for safety.

Figure 5:
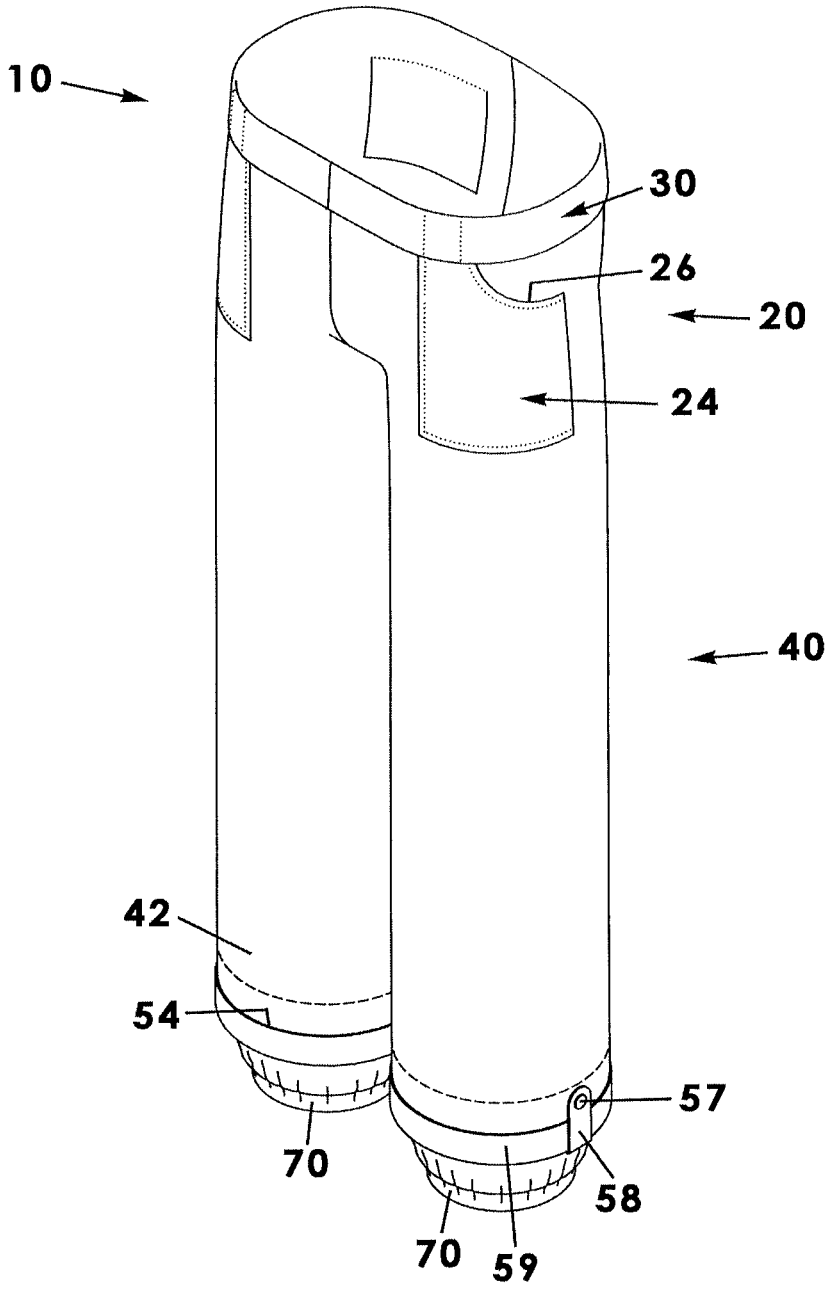
FIG. 5 is another front perspective view of the convertible garment illustrated with a lower auxiliary portion in a folded configuration.

In an embodiment, the convertible garment 10 may also include a pair of auxiliary cuff members 70, each being connected at an upper end to respective lower auxiliary portions 50 so as to extend downwardly therefrom (FIG. 5). Preferably, each auxiliary cuff member 70 may include an elastic or resilient material that may be gathered at a lower end so as to fit relatively tightly around the ankle of a person wearing the convertible garment 10. It should be observed that respective auxiliary cuff members 70 are hidden behind respective auxiliary members 50 when the lower auxiliary portions 50 are at the extended configuration (FIG. 1) but are visible when respective lower auxiliary portions 50 are at the folded configuration (FIG. 5). In one embodiment, each auxiliary cuff member 70 may include a reflective element or material instead of or in addition to the inner surface of the auxiliary portions 50 described above.

Still further, the waist portion 20 may include a pair of opposed pocket members 24 each of which define an interior area capable of holding articles such as car keys, medical equipment, or other articles. Each pocket member 24 defines an opening 26 through which access to respective interior areas may be obtained (FIG. 1). It is understood that respective pocket openings 26 are partially covered by the upper auxiliary portion 30 when positioned at the folded configuration (FIG. 4). Now with more specific reference to the structures shown in FIGS. 1 and 4, each pocket member 24 includes a lower portion 24*a* defining the interior area configured to receive articles as described above and an upper portion FIG. 24*b* extending upwardly from a respective inside edge of the lower portion 24*a*, the upper portion extending across or atop the upper auxiliary portion 30 (FIG. 1). Together, the upper portion 24*b* and lower portion 24*a* of respective pocket members define upper and lower openings, respectively (shown but not numbered individually). When the upper auxiliary portion 30 is at the folded configuration as shown in FIG. 4, the upper auxiliary portion 30 of the convertible garment 10 blocks access to the upper opening defined by the upper portion 24*b* of the pocket member 24 and allows access to the lower opening defined by the lower portion 24*a* of the pocket member 24 so that articles are removable from the interior area of the pocket member 24.

In use, the upper auxiliary portion 30 and lower auxiliary portion 50 may be positioned at respective folded configurations as described above such that the garment 10 may be used functionally as scrubs. Then, if the scrubs need to be converted to more formal pants, the upper auxiliary portion 30 and lower auxiliary portion 50 are moved to the extended configurations. Alternatively, the garment 10 may be considered "formal" with the lower auxiliary portions 50 folded so as to display respective auxiliary cuff members 70 which are in the form of more formal pants that hug the ankles.

Figure 6:
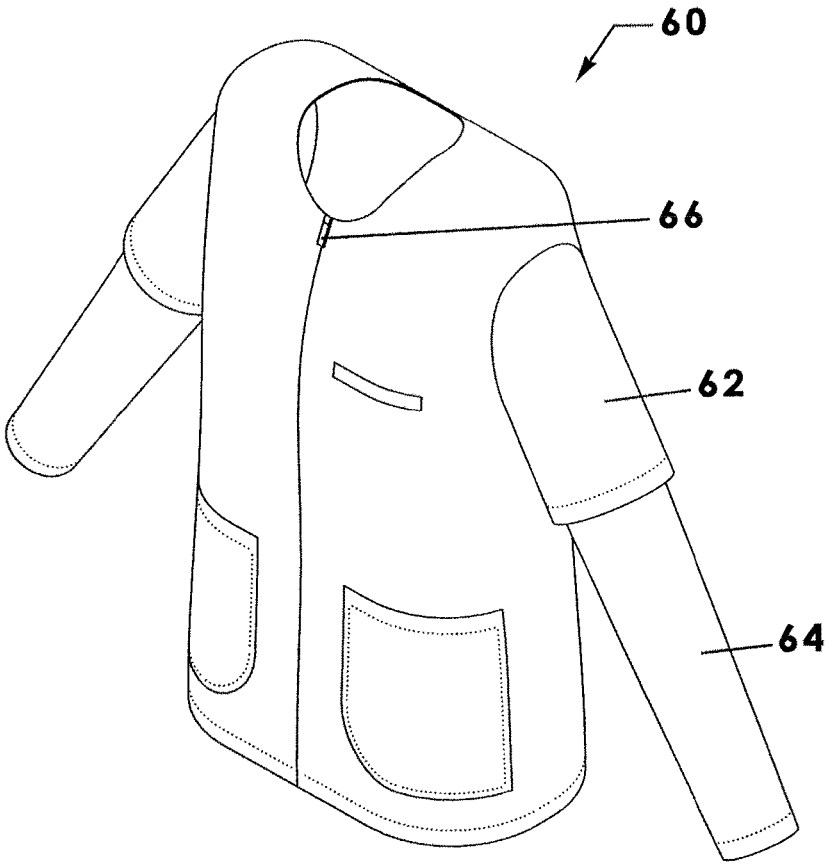
FIG. 6 is a perspective view of a shirt member of the convertible garment as in FIG. 1, illustrated with a long sleeve portion in an extended configuration.
Figure 7:
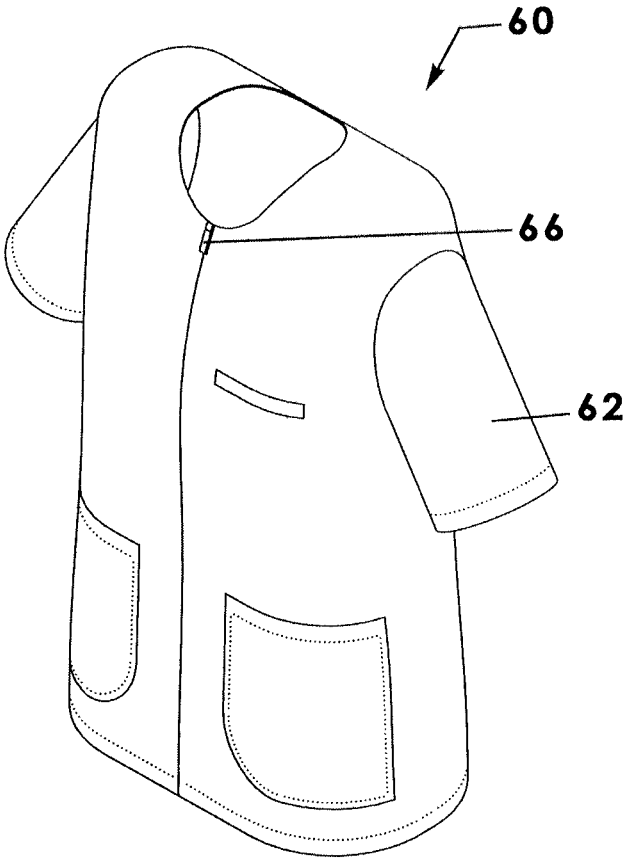
FIG. 7 is a perspective view of the shirt member as in FIG. 6, illustrated with the sleeve portion in a retracted configuration.

The convertible garment 10 may include other variations of the concept described above. For instance, the convertible garment 10 may include a shirt or jacket 60 that is convertible between a short sleeve garment (FIG. 7) and a long sleeved garment (FIG. 6). More particularly, the shirt 60 includes a pair of sleeve portions. Each sleeve portion is movable between a short sleeve configuration in which only short sleeve sections 62 are seen (FIG. 7) and a long sleeve configuration in which long sleeve sections 64 are also seen (FIG. 6). In the short sleeve configuration, the long sleeve sections 64 are folded beneath the short sleeve sections 62 in a manner substantially similar to that described previously and may be held by fasteners (not shown).

In use, the long sleeve sections 64 may be extended down to a person's wrists to have a more formal look or rolled up (or folded up) under the short sleeve sections 62 when working. Further, the shirt 60 may include a zippered front that enables the shirt 60 to be put on or taken off by releasing the zipper 66. The zipper 66 also makes the shirt look like a more formal garment such as a jacket.

It is understood that while certain forms of this invention have been illustrated and described, it is not limited thereto except insofar as such limitations are included in the following claims and allowable functional equivalents thereof.

The invention claimed is:

1. A convertible garment, comprising:

a waist portion having an upper edge defining a continuous longitudinal axis, said upper edge not defining a free or uppermost edge of the convertible garment;

an upper auxiliary portion having a continuous lower edge foldably coupled to said upper edge of said waist portion and an opposed free upper edge, said upper auxiliary portion being selectively positioned in a folded configuration in which a front surface of said upper auxiliary portion is adjacent a front surface of said waist portion or a deployed configuration in which said front surface of said upper auxiliary portion extends upwardly from said front surface of said waist portion;

wherein said upper auxiliary portion is selectively folded at or extends upwardly from said longitudinal axis defined by said waist portion at said folded configuration;

wherein said waist portion includes a pair of opposed pocket members, each pocket member having a lower portion defining an interior area configured to hold articles and an upper portion extending upwardly from said lower portion and situated atop an entirety of said auxiliary portion, said upper portion and said lower portion of said pocket member defining an upper and lower opening, respectively, through which said interior area is accessible;

wherein said upper auxiliary portion blocks access to respective upper openings of said upper portions of respective pocket members and allows access to respective lower openings of said lower portions of respective pocket members when said upper auxiliary portion is in said folded configuration;

a pair of leg portions extending downwardly from said waist portion, each leg portion having a lower end; and a pair of lower auxiliary portions each having an upper edge coupled to respective lower ends of respective leg portions and having an opposed free edge, each respective lower auxiliary portions being movable between a folded configuration in which a front face of said respective lower auxiliary portion is adjacent a corresponding front face of a respective leg portion and an extended configuration in which said front face of said respective lower auxiliary portion extends away from said front face of said respective leg portion.

2. The convertible garment as in claim 1, wherein:

said upper auxiliary portion is generally parallel to said waist portion when said upper auxiliary portion is positioned at said folded configuration and said upper auxiliary portion is generally co-planar with said waist portion when said upper auxiliary portion is positioned at said extended configuration; and said respective lower auxiliary portions are generally parallel to respective leg portions at said folded configurations and are generally co-planar with said respective leg portions at said extended configurations.

3. The convertible garment as in claim 2, comprising a strap coupled to said each lower auxiliary portion adjacent a respective free edge thereof, said strap including a free end having a second fastener having a configuration complementary to a configuration of said first fastener.

4. The convertible garment as in claim 3, wherein each lower auxiliary portion includes an inner surface having a reflective element, said inner surface being visible when said lower auxiliary portion is at said folded configuration.

5. The convertible garment as in claim 1, comprising:

at least one first fastener situated adjacent each lower end of each respective leg portion; and at least one second fastener operatively coupled to each lower auxiliary portion, said at least one second fastener having a configuration complementary to a configuration of said at least one first fastener;

wherein a respective lower auxiliary portion is secured at said folded configuration when a respective second fastener is coupled to a corresponding first fastener.

6. The convertible garment as in claim 5, wherein said at least one second fastener is fixedly attached to said respective lower auxiliary portion.

7. The convertible garment as in claim 1, wherein each lower auxiliary portion includes an inner surface having a reflective element, said inner surface being visible when said lower auxiliary portion is at said folded configuration.

8. The convertible garment as in claim 1, comprising a pair of auxiliary cuff members, each auxiliary cuff member being connected at an upper end to a respective lower auxiliary portion and configured to extend downwardly therefrom.

9. The convertible garment as in claim 1, wherein each auxiliary cuff member includes an elastic or resilient material that is gathered at a lower end thereof so as to fit tightly around the ankle of a person.

10. The convertible garment as in claim 1, further comprising a shirt displaced from said waist portion and having a pair of sleeve portions, each sleeve portion being selectively movable between a short sleeve configuration having short sleeve sections and a long sleeve configuration having long sleeve sections extending away from said short sleeve sections.

11. The convertible garment as in claim 10, wherein said shirt includes a zipper assembly that is selectively operable to open or close said shirt.

12. The convertible garment as in claim 1, comprising:

a shirt displaced from said waist portion and having a pair of sleeve portions, each sleeve portion being selectively movable between a short sleeve configuration having short sleeve sections and a long sleeve configuration having long sleeve sections extending away from said short sleeve sections; and wherein said shirt includes a zipper assembly that is selectively operable to open or close said shirt.

13. A convertible garment, comprising:

a waist portion having an upper edge defining a continuous longitudinal axis, said upper edge not defining a free or uppermost edge of the convertible garment;

an upper auxiliary portion having a continuous lower edge foldably coupled to said upper edge of said waist portion and an opposed free upper edge, said upper auxiliary portion being selectively positioned in a folded configuration in which a front surface of said upper auxiliary portion is adjacent a front surface of said waist portion or a deployed configuration in which said front surface of said upper auxiliary portion extends upwardly from said front surface of said waist portion;

wherein said upper auxiliary portion is selectively folded at or extends upwardly from said longitudinal axis defined by said waist portion at said folded configuration;

wherein said waist portion includes a pair of opposed pocket members, each pocket member having a lower portion defining an interior area configured to hold articles and an upper portion extending upwardly from said lower portion and situated atop an entirety of said auxiliary portion, said upper portion and said lower portion of said pocket member defining an upper and lower opening, respectively, through which said interior area is accessible;

wherein said upper auxiliary portion blocks access to respective upper openings of said upper portions of respective pocket members and allows access to respective lower openings of said lower portions of respective pocket members when said upper auxiliary portion is in said folded configuration;

a pair of leg portions extending downwardly from said waist portion, each leg portion having a lower end; and a pair of lower auxiliary portions each having an upper edge coupled to respective lower ends of respective leg portions and having an opposed free edge, each respective lower auxiliary portions being movable between a folded configuration in which a front face of said respective lower auxiliary portion is adjacent a corresponding front face of a respective leg portion and an extended configuration in which said front face of said respective lower auxiliary portion extends away from said front face of said respective leg portion;

wherein each lower auxiliary portion includes an inner surface having a reflective element, said inner surface being visible when said lower auxiliary portion is at said folded configuration;

wherein each auxiliary cuff member includes an elastic or resilient material that is gathered at a lower end thereof so as to fit tightly around the ankle of a person.

* * * * *